US005442130A

United States Patent [19]

Kitayama et al.

[11] Patent Number: 5,442,130

[45] Date of Patent: Aug. 15, 1995

[54] MUSICAL TONE SYNTHESIZING APPARATUS USING COMB FILTER

[75] Inventors: Toru Kitayama; Yoichiro Ogai, both of Hamamatsu, Japan

[73] Assignee: Yamaha Corporation, Japan

[21] Appl. No.: 25,282

[22] Filed: Mar. 2, 1993

[30] Foreign Application Priority Data

Mar. 3, 1992 [JP] Japan ..... 4-081546

[51] Int. Cl.[6] ..... G10H 5/00; G10H 1/12

[52] U.S. Cl. ..... 84/661; 84/659; 84/DIG. 9

[58] Field of Search ..... 84/615, 616, 622, 624, 84/659, 661, 698, 699, DIG. 10, DIG. 9

[56] References Cited

U.S. PATENT DOCUMENTS

| | | | |
|---|---|---|---|
| 4,649,783 | 3/1987 | Strong et al. . | |
| 4,984,276 | 1/1991 | Smith . | |
| 5,212,334 | 5/1993 | Smith, III | 84/DIG. 9 |
| 5,241,127 | 8/1993 | Kobayashi | 84/616 |
| 5,245,127 | 9/1993 | Yamauchi et al. | 84/624 |
| 5,264,659 | 11/1993 | Kunimoto | 84/661 |
| 5,272,275 | 12/1993 | Kunimoto | 84/661 |
| 5,286,914 | 2/1994 | Kunimoto | 84/660 X |
| 5,286,915 | 2/1994 | Komano et al. | 84/661 X |
| 5,286,916 | 2/1994 | Yamauchi | 84/661 |

FOREIGN PATENT DOCUMENTS

| | | |
|---|---|---|
| 53-88715 | 4/1978 | Japan . |
| 59-19354 | 5/1984 | Japan . |

*Primary Examiner*—William M. Shoop, Jr.
*Assistant Examiner*—Jeffrey W. Donels
*Attorney, Agent, or Firm*—Graham & James

[57] ABSTRACT

The musical tone synthesizing apparatus utilizes a loop circuit receptive of an input signal for looping the same with a given delay time to produce an output signal representative of a musical tone. The loop circuit includes a delay element for delaying the input signal and a feedback path for feeding back the delayed input signal to the delay element. A control unit is provided for controlling the delay element according to a designated pitch of a musical tone so as to set the delay time of the loop circuit to thereby determine the pitch of the musical tone. A generator generates the input signal containing various frequency components. A high-pass filter is connected precedingly to the loop circuit for selectively attenuating relatively lower frequency components of the input signal, which have periods longer than the set delay time of the loop circuit.

21 Claims, 7 Drawing Sheets

MUSICAL TONE SYNTHESIZING APPARATUS USING COMB FILTER

BACKGROUND OF THE INVENTION

The present invention relates to a musical tone synthesizing apparatus for use in an electronic musical instrument, and more specifically relates to the musical tone synthesizing apparatus of the type utilizing a comb filter having a plurality of resonance peaks for producing desired frequency components of the musical tone from an input signal containing various frequency components.

For example, there has been known the conventional musical tone synthesizing apparatus having a loop circuit including a delay element to constitute a comb filter having a plurality of resonance peaks and being receptive of a white noise signal to selectively filter desired frequency components so as to form a musical tone. Such a type of the musical tone synthesizing apparatus is disclosed, for example, in Japanese patent application publication No. 19354/1984. Generally, the white noise signal contains very low frequency components close to DC. When the white noise signal is continuously fed to the comb filter composed of the loop circuit set with a given delay time for a long time, the looped very low frequency component of the same polarity is repeatedly accumulated to thereby exceed a processing limit so that the loop circuit may overflow, thereby causing a problem such as to fail generation of the musical tone.

SUMMARY OF THE INVENTION

In view of the above noted problem of the prior art, an object of the present invention is to provide a musical tone synthesizing apparatus constructed to prevent overflow of the looping circuit which might be caused by feeding back very low frequency components to an input signal formed based on a white noise or another input signal deviated to positive or negative polarity. According to the present invention, a musical tone synthesizing apparatus comprises looping means receptive of an input signal for looping the same with a given delay time to produce an output signal representative of a musical tone, the looping means including delay means for delaying the input signal and feedback means for feeding back the delayed input signal to the delay means, designating means for designating a pitch of a musical tone to be synthesized, control means for controlling the delay means according to the designated pitch so as to set the delay time of the looping means to thereby determine the pitch of the musical tone, generating means for generating said input signal containing various frequency components, and attenuating means connected precedingly to or disposed internally in the looping means for selectively attenuating relatively lower frequency components of the input signal, which have periods longer than the set delay time of the looping means. Preferably, compensating means is connected to the looping means for compensating for attenuation of the lower frequency components of the input signal by the attenuating means.

DETAILED DESCRIPTION OF EMBODIMENTS

Figure 1:
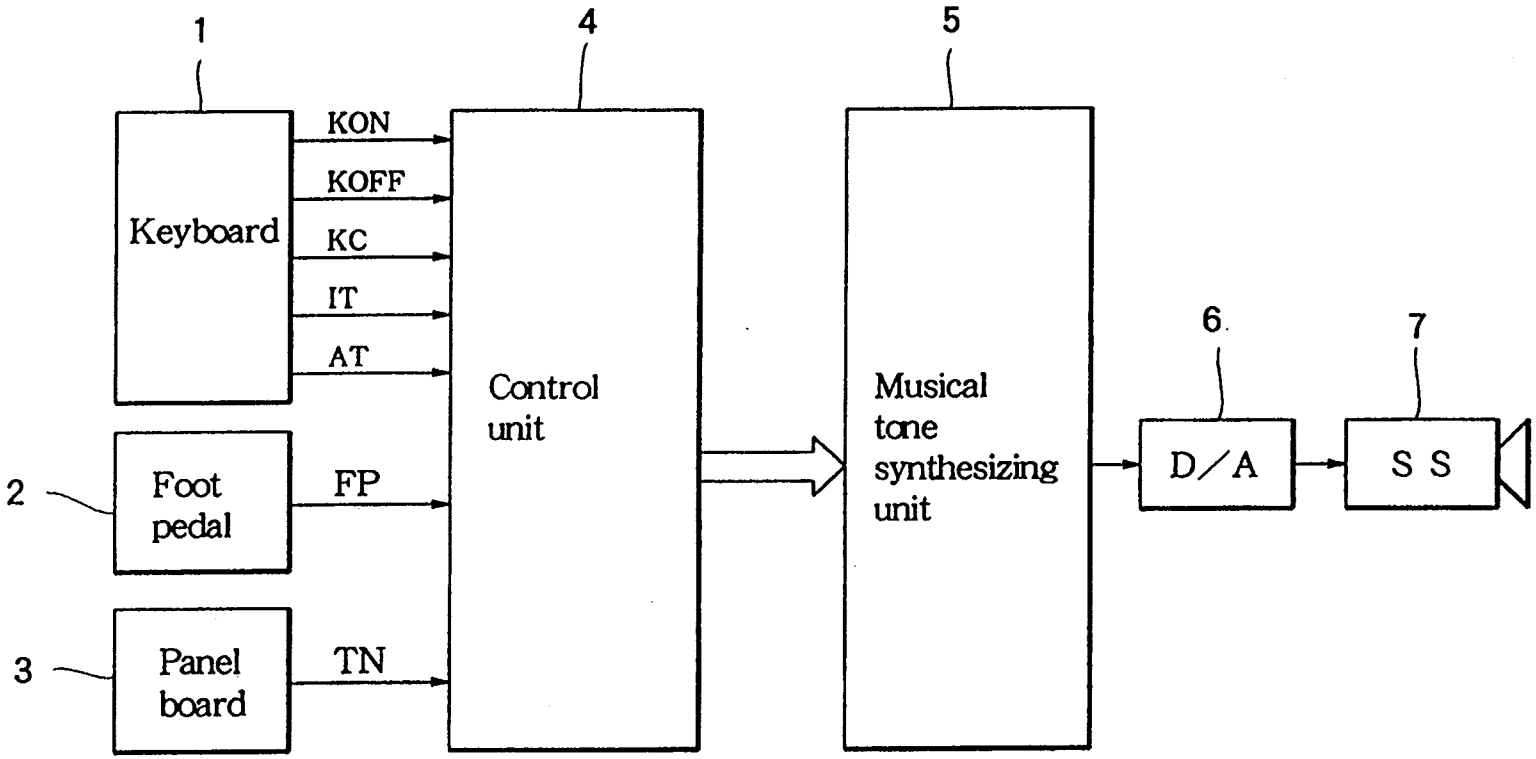
FIG. 1 is a block diagram showing an overall construction of an electronic musical instrument provided with a musical tone synthesizing apparatus according to the present invention.

Hereinafter, embodiments of the present invention will be described in conjunction with the drawings. FIG. 1 is a block diagram showing an overall construction of an electronic musical instrument provided with a musical tone synthesizing apparatus according to the invention. Those of a keyboard 1, a foot pedal 2 and a panel board 3 are connected to a control unit 4. The keyboard 1 is manually operated to provide to the control unit 4 performance information including a key-on signal KON indicative of key depression, a key-off signal KOFF indicative of key release, a key code signal KC indicative of a tone pitch associated to operated keys, an initial touch data IT indicative of key depression velocity and an after touch data AT indicative of pressing state after the key depression. The foot pedal 2 provides a foot pedal signal FP indicative of a tread degree thereof to the control unit 4. The panel board 3 provides a timbre signal TN indicative of a timbre selected by a player to the control unit 4. The control unit 4 determines values of various control parameters based on these signals and data inputted from the keyboard 1, foot pedal 2 and panel board 3 for use in synthesis of musical tones. The control unit 4 feeds the determined values of the control parameters to a musical tone synthesizing unit 5. The synthesizing unit 5 generates a musical tone signal synthesized according to the inputted values of the control parameters. The musical tone signal is fed to a sound system (SS) 7 through a digital/analog converter (D/A) 6. The sound system 7 includes an amplifier and a speaker for sounding a musical tone according to the musical tone signal.

Figure 2:
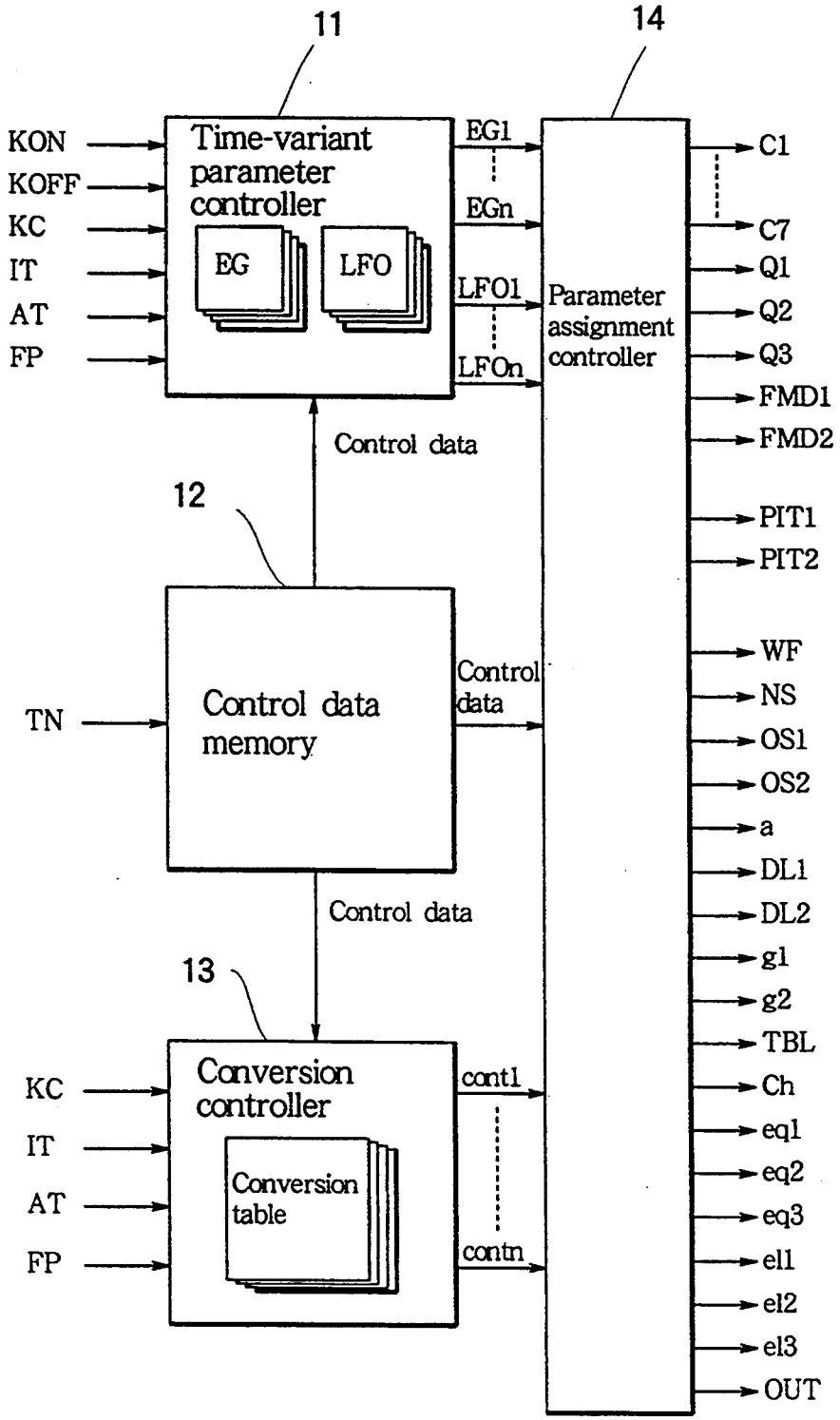
FIG. 2 is a block diagram showing structure of a control unit provided in the electronic musical instrument of FIG. 1.

FIG. 2 is a block diagram showing structure of the control unit 4. The control unit 4 is comprised of a time-variant parameter controller 11, a control data memory 12, a conversion controller 13, and a parameter assignment controller 14. The time-variant parameter controller 11 receives those of key-on signal KON, key-off signal KOFF, key code signal KC, initial touch data IT, after touch data AT and foot pedal signal FP. The time-variant parameter controller 11 includes an envelope generator (EG) and a low frequency oscillator (LFO), and feeds to the parameter assignment controller 14 envelope data EG1-EGn and output data LFO1-LFOn of the low frequency oscillator, determined according to the various inputted signals. The envelope data EG1-EGn are effective to determine an envelope of a musical tone to be generated. The data LFO1-LFOn are effective to periodically vary control parameters. The control data memory 12 is provided with the timbre signal TN so that stored control data is read out in response to the inputted timbre signal TN, and is fed to the respective controllers 11, 13 and 14. The conversion controller 13 is inputted with those of key code signal KC, initial touch data IT, after touch data AT and foot pedal signal FP. The conversion controller 13 converts the key-code signal KC into a delay time to be set into a delay element of the musical tone synthesizing unit to designate a tone pitch (which will be described later). The conversion controller 13 further converts the initial touch data IT, after touch data AT and foot pedal signal FP by using respective conversion tables, and scales converted results by the key code signal KC. The converted and scaled results are fed to the parameter assignment controller 14 in the form of control signals cont1-contn. For example, a certain conversion table is used for converting the tread degree of the foot pedal into a corresponding control signal. By such a manner, the conversion controller 13 outputs the control signals cont1-contn representative of a tone pitch and other time-variant tone elements performed by the player. The parameter assignment controller 14 carries out matrix control based mainly on control data corresponding to the timbre signal TN, such as to determine various control parameters including control coefficients C1–C7, Q1–Q3 and so on according to the inputted control data and control signals. These control parameters or coefficients C1–C7 and Q1–Q3 etc. are fed to the musical tone synthesizing unit 5 to variably control characteristics of filters and delay elements within the musical tone synthesizing unit 5. By such a construction of the control unit shown in FIG. 2, various control parameters or coefficients are fed to the musical tone synthesizing unit 5 in order to synthesize a musical tone having desired pitch and timbre in response to operation of the keyboard and foot pedal by the player.

Figure 3:
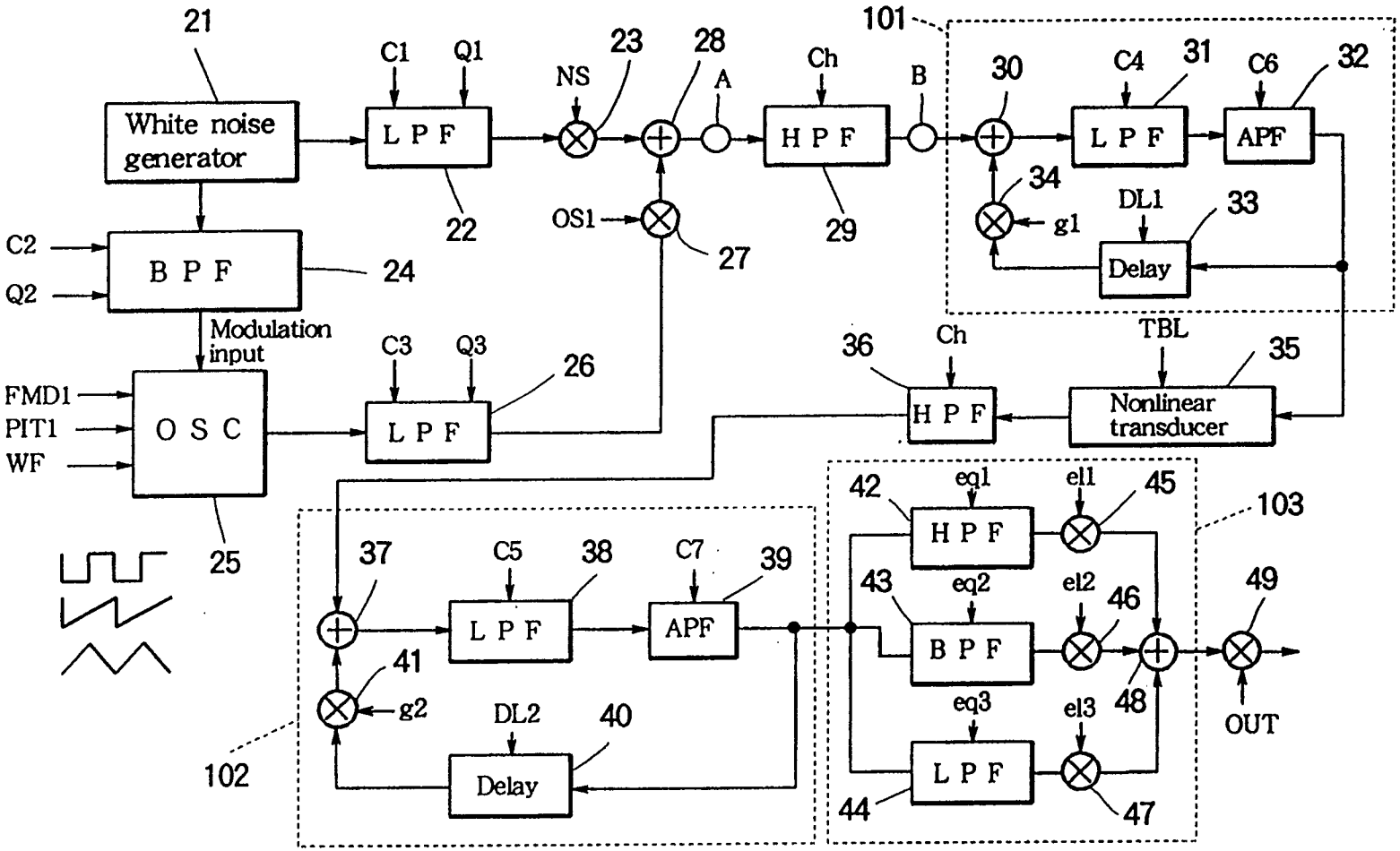
FIG. 3 is a circuit diagram showing a first embodiment of the musical tone synthesizing apparatus.

FIG. 3 is a circuit block diagram showing a first embodiment of the musical tone synthesizing unit 5. A white noise generator 21 generates a white noise signal. The generated white noise signal is fed to an adder 28 through a low-pass filter (LPF) 22 and a multiplier 23, and is also fed to a modulation input terminal of an oscillator (OSC) 25 through a band-pass filter (BPF) 24. The oscillator 25 generates a square wave signal, a sawtooth wave signal or a triangular wave signal. The generated wave signal is outputted after being frequency-modulated according to the signal received at the modulation input terminal. The oscillator 25 receives from the control unit a coefficient PIT1 effective to control an oscillating frequency, another coefficient FMD1 effective to control a depth of the frequency-modulation and a further coefficient WF effective to select one of square, sawtooth and triangular waveforms for the oscillating signal. The oscillating frequency, the depth of the frequency-modulation and the oscillating waveform are determined by values of these coefficients. In this oscillator 25, the oscillating frequency thereof is not required proportional to a pitch of the musical tone to be synthesized and therefore may be rather fixed, because the pitch of the musical tone generated by the synthesizing unit is determined by means of a delay element, which will be described later. In case that the oscillating frequency is fixed, timbre of the musical tone varies dependently on the tone pitch, thereby producing a musical tone full of variety. The oscillator 25 is connected to the adder 28 through a low-pass filter (LPF) 26 and a multiplier 27. These LPF 22, BPF 24 and LPF 26 receive from the control unit, respectively, filter coefficients C1–C3 effective to control a cutoff frequency thereof and other filter coefficients Q–Q3 effective to control a resonance degree thereof. The cutoff frequency and the resonance degree of these filters are determined by the filter coefficients C1–C3 and Q1–Q3. The multiplier 23 is applied with a coefficient NS effective to control a power level of the white noise signal fed to the adder 28. The other multiplier 27 is applied with a coefficient OSI effective to control a level of the oscillating wave signal which is fed from the oscillator 25 and which is mixed to the white noise signal by the adder 28.

An output of the adder 28 is fed through a high-pass filter (HPF) 29 to an adder 30 contained in a first loop circuit 101. The HPF 29 receives from the control unit a filter coefficient Ch effective to control and set a cutoff frequency of the HPF 29. The first loop circuit 101 is comprised of a feedback path connection of adder 30, low-pass filter (LPF) 31, all-pass filter (APF) 32, delay element 33 and multiplier 34. The APF 32 brings about phase variation dependently on frequency of the input signal while maintaining amplitude thereof. The APF 32 is provided with a filter coefficient C6 effective to control phase characteristic thereof. The LPF 31 is provided with a filter coefficient C4 effective to control a cutoff frequency thereof. The delay element 33 is provided with a coefficient DL1 effective to control a delay amount thereof. The multiplier 34 is provided with a coefficient g1 effective to control a feedback gain thereof.

An output at the APF 32 of the first loop circuit 101 is fed to an adder 37 of a second loop circuit 102 through a nonlinear transducer 35 and a high-pass filter (HPF) 36. The nonlinear transducer 35 carries out nonlinear transducing of the output signal from the first loop circuit 101, and is constructed to select one of plural nonlinear transducing tables to determine nonlinear input/output characteristic thereof. The nonlinear transducer 35 receives from the control unit a coefficient TBL effective to select a desired one of the transducing tables. The HPF 36 has the same structure as that of the HPF 29 and receives the same filter coefficient Ch. The second loop circuit 102 is comprised of a feedback path connection of adder 37, low-pass filter (LPF) 38, all-pass filter (APF) 39, delay element 40 and multiplier 41, in manner similar to the first loop circuit 101. The LPF 38 receives a filter coefficient C5, the APF 39 receives another filter coefficient C7, the delay element 40 receives a delay amount control coefficient DL2, and the multiplier 41 receives a feedback gain coefficient g2.

An output terminal at the APF 39 of the second loop circuit 102 is connected to respective input terminals of high-pass filter (HPF) 42, band-pass filter (BPF) 43 and low-pass filter (LPF) 44. These HPF 42, BPF 43 and LPF 44 are connected through respective multipliers 45, 46 and 47 to an adder 48. The filters 42–44, multipliers 45–47 and adder 48 constitute altogether an equalizer 103. The filters 42–44 receive coefficients eq1–eq3, respectively, from the control unit, and the multipliers 45–47 receive coefficients el1–el3, respectively, from the control unit. Characteristics of the equalizer 103 is determined by values of these coefficients eq1–eq3 and el1–el3. An output of the equalizer 103 (at an output terminal of the adder 48) is fed to a multiplier 49. An output signal of the musical tone synthesizing unit 5 is provided at an output terminal of the multiplier 49 and is fed to the D/A converter 6. The multiplier 49 receives from the control unit 4 a coefficient OUT effective to control a level of the final output signal representative of a musical tone.

Next, the description will be given for operation of the thus constructed musical tone synthesizing unit 5. The white noise signal generated from the white noise generator 21 is fed to the adder 28 through the LPF 22 and the multiplier 23. The white noise signal is also fed to the oscillator 25 through the BPF 24. The oscillating wave signal of the oscillator 25 is frequency-modulated by this filtered white noise signal to impart desired fluctuation to the oscillating wave signal. The frequency, waveform and modulation depth of the oscillating wave signal are controlled by respective control coefficients PIT1, WF and FMD1. The output of the oscillator 25 is fed through the LPF 26 and multiplier 27 to the adder 28, where the output wave signal of the oscillator 25 is mixed to the white noise signal. The mixing of the wave signal modulated by the noise can impart a desired characteristic mode to a synthesized musical tone as compared to utilizing a pure white noise as an input signal. Further, the imparted characteristic mode can be altered by changing the various control parameters or coefficients such as C1, Q1 and so on, which are applied to the LPF 22, BPF 24, LPF 26, multipliers 23 and 27, and oscillator 25.

The output of the adder 28 is inputted into the loop circuit 101 through the HPF 29. FIG. 4B shows amplitude-frequency characteristic of the HPF 29. In the graph of FIG. 4B, the curve A represents the input signal form appearing at an input node A (FIG. 3) of the HPF 29, and the curve B represents the output signal form observed at an output node B (FIG. 3) of the HPF 29. The cutoff frequency of the HPF 29 is set by the filter coefficient Ch. This HPF 29 is interposed to eliminate or attenuate very low frequency components close to DC, contained in the white noise input signal.

Figure 4A:
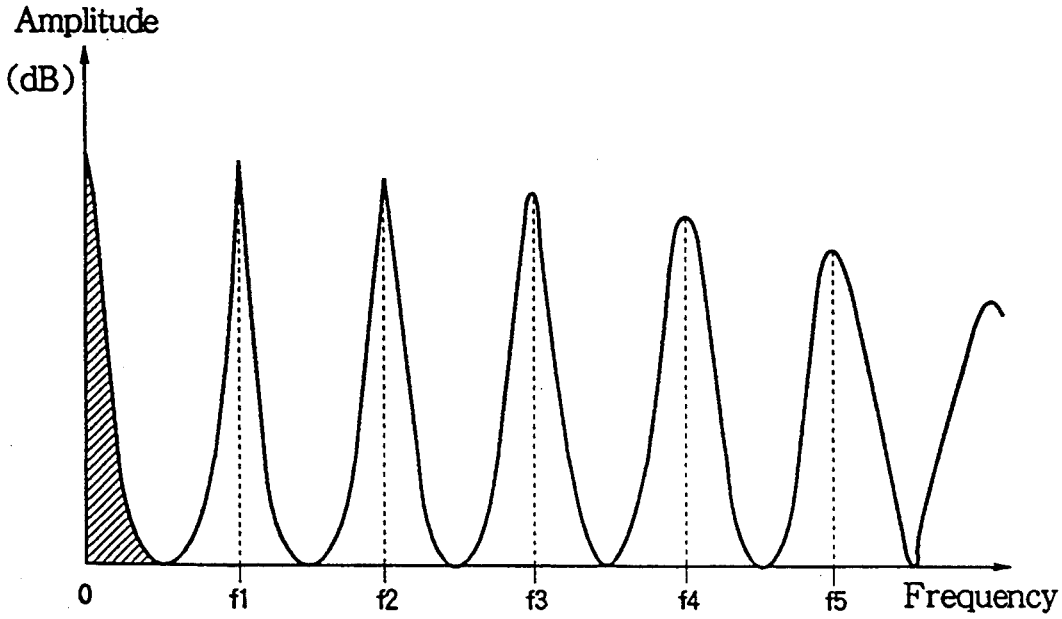
FIG. 4A is a diagram showing frequency characteristics of a loop circuit contained in the first embodiment.
Figure 4B:
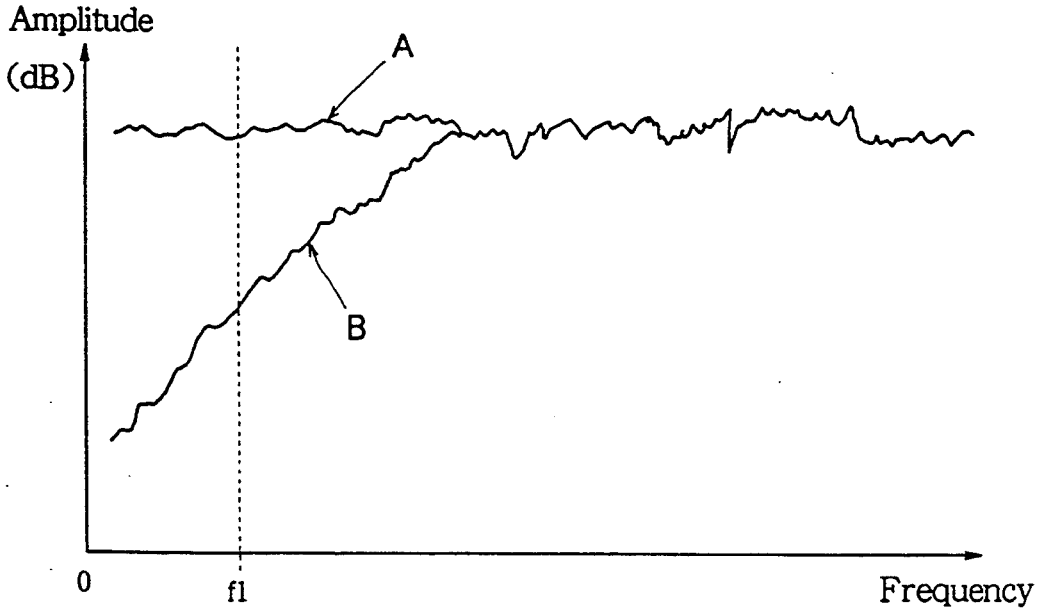
FIG. 4B is a diagram showing frequency characteristics of a high-pass filter contained in the first embodiment.

The first loop circuit 101 has an amplitude/frequency characteristic, as shown in FIG. 4A, to function as a comb filter. In the graph of FIG. 4A, a frequency f1 denotes a fundamental component of a synthesized musical tone, and frequencies f2, f3, . . . denote harmonic components thereof. Since a phase delay is caused variably by the APF 32 dependently on the frequency, the respective frequencies f2, f3, . . . of resonance peaks are slightly shifted from integer multiples of the fundamental frequency f1. Further, a level of the resonance peaks gradually lowers as the frequency increases due to the performance of the LPF 31. In accordance therewith, for example, the fifth resonance peak around f5 loses sharpness to become dull as compared to the first resonance peak around f1. Further, the comb filter has a specific characteristic similar to that of an acoustic instrument to thereby realize natural sound. In this comb filter, the fundamental frequency f1 is determined by an overall delay time of the LPF 31, APF 32 and delay element 33. The LPF 31 and APF 32 are tuned to desired characteristics by setting the respective filter coefficients C4 and C6, while the control coefficient DL1 of the delay element 33 is set so that a total delay time of the phase delay amounts of these filters LPF 31, APF 32 and the delay amount of the delay element 33 is made identical to a reciprocal of the fundamental frequency f1 of a musical tone to be generated. Stated otherwise, the total delay time of the loop circuit is set identical to a period of the fundamental component of the musical tone. Alternatively, in case that the first loop circuit 101 is of negative feedback type, the total delay time is set to a half of a reciprocal of f1. The loop circuit 101 includes the adder 30 for adding the input signal and its delayed signal with one another. Therefore, if the input signal contains a DC component or a very low frequency component close to DC, its delayed component having the same polarity (having the same sign) is continuously accumulated by the adder 30 so that the adder 30 may overflow to cause malfunction. In view of this, the HPF 29 is connected precedingly to the loop circuit 101 in the present embodiment so as to attenuate very low frequency components having periods longer than the delay time of the loop circuit, as indicated by the hatching portion of FIG. 4A to thereby avoid such malfunction of the adder 30.

Figure 5A:
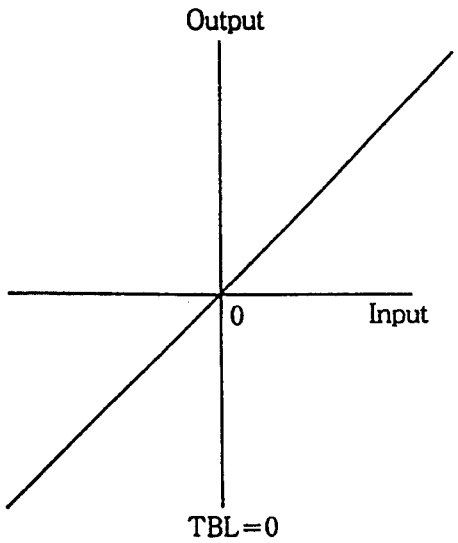
FIGS. 5A–5D are a diagram showing various input/output characteristics of a nonlinear transducer contained in the first embodiment.
Figure 5B:
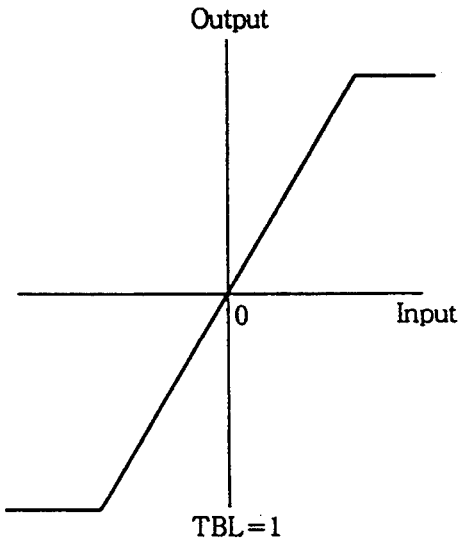
Figure 5C:
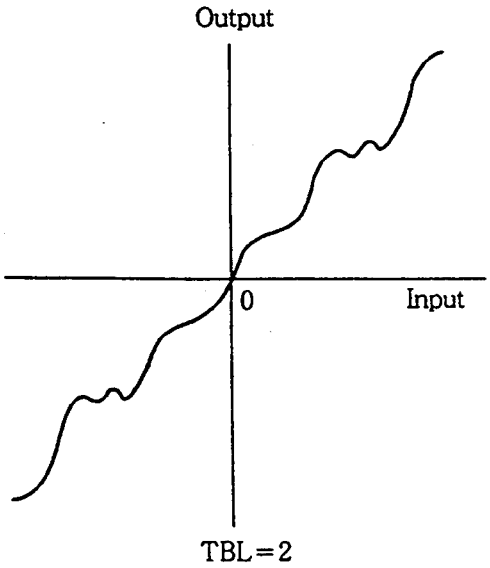
Figure 5D:
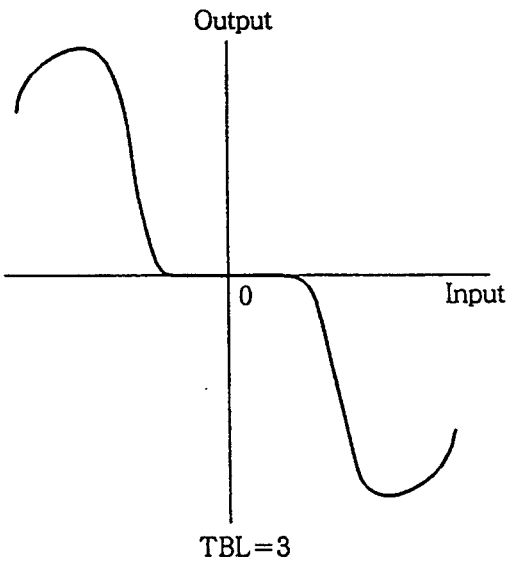

The nonlinear transducer 35 connected to the first loop circuit 101 is operated according to the value of the control coefficient TBL to select one of the four kinds of input/output tables shown in FIGS. 5A–5D. Namely, in case of TBL =0, the first table of FIG. 5A is selected so that the nonlinear transducer 35 outputs an input signal as it is. In case of TBL=1, the second table of FIG. 5B is selected so that the output signal is held constant when an absolute value of the input signal exceeds a given level. In case of TBL=2, the third table of FIG. 5C is selected so that the input signal is amplitude-transduced to produce the output signal having delicate variation. In case of TBL=3, the fourth table of FIG. 5D is selected so that the polarity of the input signal is inverted to produce the output signal. By such a manner, the transduced output from the nonlinear transducer 35 may contain increased lower frequency components close to the DC component, hence the transduced output is fed to the second loop circuit 102 through the second HPF 36. In this embodiment, the second HPF 36 uses the filter coefficient Ch as same as that of the first HPF 29; however another filter coefficient of different value may be utilized alternately. In the second loop circuit 102, the various control coefficients C5, C7, DL2 and g2 are set such that the second loop circuit 102 performs the substantially same comb filter characteristic as that of the first loop circuit 101 shown in FIG. 4A. The second loop circuit 102 is connected in series to the first loop circuit 101 to sharpen each resonance peaks shown in FIG. 4A to intensify specific frequency components to thereby improve tune of synthesized sounds. Therefore, the respective control coefficients C5, C7, DL2 and g2 may be set to the same values as those in the first loop circuit 101.

The thus produced tone signal may be occasionally poor or insufficient in a lower pitch range, because there is not available a practical HPF which can selectively attenuate the hatching portion of the FIG. 4A spectrum. An ideal HPF might be very expensive and would not be practical. In the embodiment, a practical HPF is inserted to attenuate some lower frequency components so as to prevent the overflow of the adder in the loop circuit, while the essentially indispensable tone range may be coincidentally suppressed. For example, in the FIG. 4B graph, it is observed that the amplitude level is excessively lowered around the fundamental frequency f1. In view of this, the equalizer 103 is provided to compensate for frequency characteristics of the lower frequency components which are attenuated mainly by the HPFs 29 and 36. The various control parameters or coefficients eq1–eq3 and el1–el3 are set such as to obtain the desired frequency characteristic of the tone signal. Such a construction can effectively prevent the synthesized musical tone from insufficiency of the lower pitch range, which would be caused by the insertion of HPFs 29 and 36.

As described above, the present embodiment utilizes the HPFs 29 and 36 to avoid overflow of the adders 30 and 37 provided in the first and second loop circuits 101 and 102, respectively. Further, the equalizer 103 is provided to prevent deterioration of the tone quality, which would be caused by the addition of HPFs 29 and 36. In modification, the HPF 29 may be disposed internally in the first loop circuit 101, for example, between the adder 30 and the LPF 31, or between the delay element 33 and the multiplier 34. The HPF 36 may be placed in similar manner. Further, the input signal generating source may be not limited to the type generating the white noise signal, but may include other types generating a wave signal containing harmonic components and a fundamental component which has a period longer than the one cycle delay time of the loop circuits 101 and 102.

Figure 6:
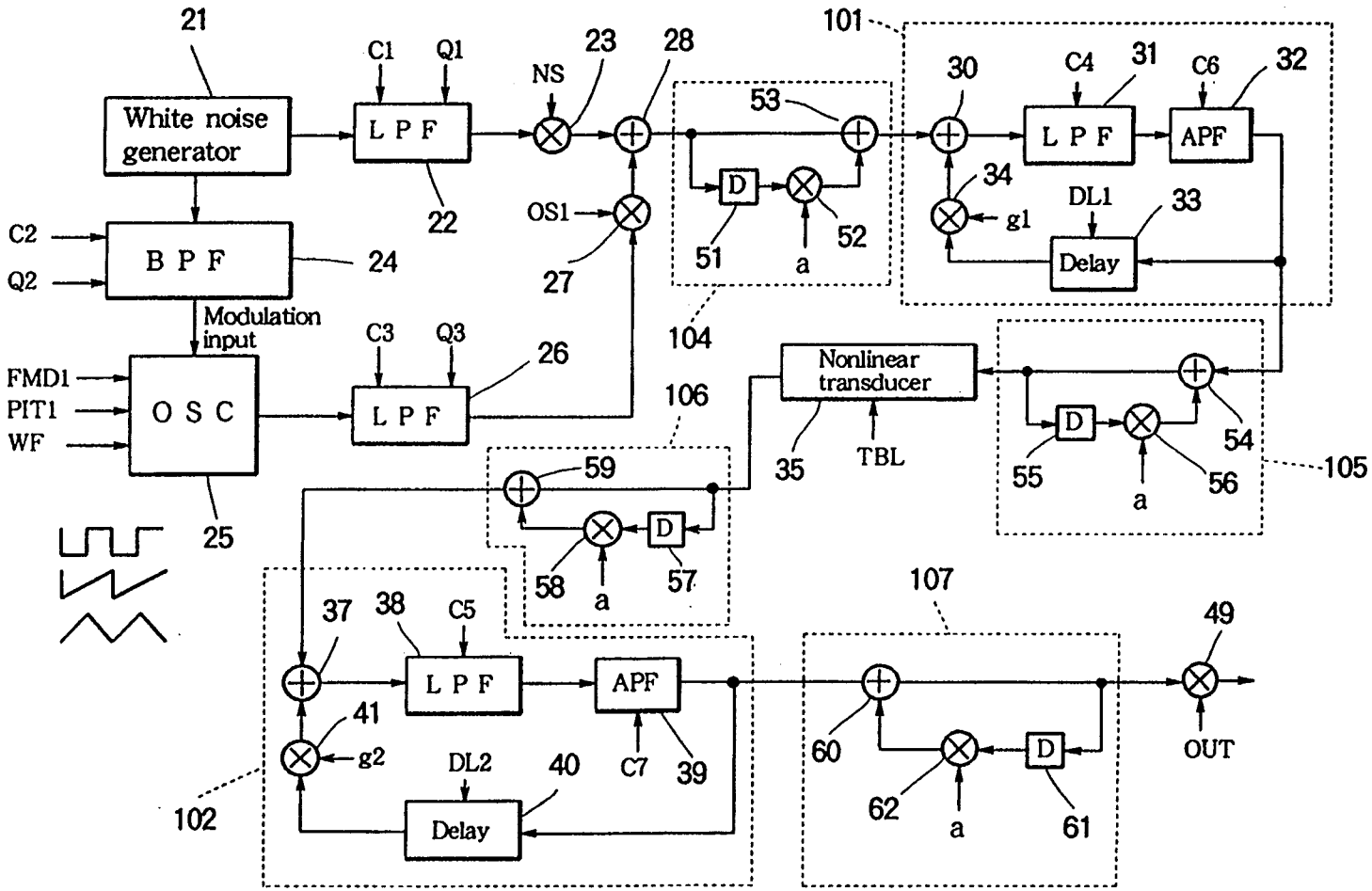
FIG. 6 is a circuit diagram showing a second embodiment of the musical tone synthesizing apparatus.

FIG. 6 is a block diagram showing a second embodiment of the inventive musical tone synthesizing unit. In this embodiment, the same component is labeled by the same reference numeral as the FIG. 3 embodiment. In this embodiment, first and second encoders 104 and 106 are provided in place of the HPFs 29 and 36 of the FIG. 3 embodiment. Further, a first decoder 105 is interposed between the first loop circuit 101 and the nonlinear transducer 35. Moreover, a second decoder 107 is provided in place of the equalizer 103 of the FIG. 3 embodiment. The remaining components are identical to those of the FIG. 3 circuit. The first encoder 104 is composed of a delay element 51, a multiplier 52 and an adder 53. The multiplier 52 is operated according to a control coefficient "a" which is variably settable between 0 and 1. The encoder 104 is constructed to output a difference between an input signal and its delayed signal multiplied by the factor "a", thereby performing as a high-pass filter of FIR type, as a whole. The first decoder 105 is composed of an adder 54, a delay element 55 and a multiplier 56. The multiplier 56 is controlled by the same control coefficient "a" as in the first encoder 104. The decoder 105 is constructed to produce a sum of an input signal and a delayed signal of its output signal multiplied by the factor "a", thereby having a filter characteristic complementary to that of the first encoder 104. Namely, the serial connection of the first encoder 104 and decoder 105 has a composite transfer function of "1"to ensure the flat filter characteristic. The first loop circuit 101 are fed with an input signal having lower frequency components close to DC, which are attenuated precedingly by the first encoder 104, thereby preventing overflow in the adder 30. Further, the first decoder 105 operates to compensate for the attenuated lower frequency components to thereby prevent deterioration of the synthesized tone quality. The second encoder 106 and the second decoder 107 have the same construction as those of the first encoder 104 and the first decoder 105, respectively. In this embodiment, the delay elements 57, 61 have the same delay amount as those of the delay elements 51, 55. Further, the second encoder 106 and decoder 107 are operated by the same control coefficient "a" as that of the first encoder 104 and decoder 105. The second encoder 106 can prevent undesired distortion which would be caused when the nonlinear transducer 35 generates lower frequency components close to DC.

In modification, the second encoder 106 and the second decoder 107 may have different characteristics than those of the first encoder 104 and the first decoder 105. It is sufficient that the second encoder 106 and the second decoder 107 have the opposite or complementary characteristics with each other. If a single pair of encoder and decoder are coupled to each other through a linear circuit, their complementary characteristics are maintained perfectly. However, if a nonlinear circuit is interposed between the pair of encoder and decoder, their complementary relation is not held. In view of this, the first and second pairs of encoder and decoder are disposed separately before and after the nonlinear transducer 35. If the nonlinear transducer is eliminated, a single pair of encoder and decoder can be disposed opposite sides of the serial connection of the first and second loop circuits. In another modification, the encoders 104 and 106 may be disposed, respectively, within the first and second loop circuits 101 and 102. In such a case, the decoders may not be the same type, but should be designed according to inverse calculation of the transfer function so as to effect perfect compensation.

Figure 7:
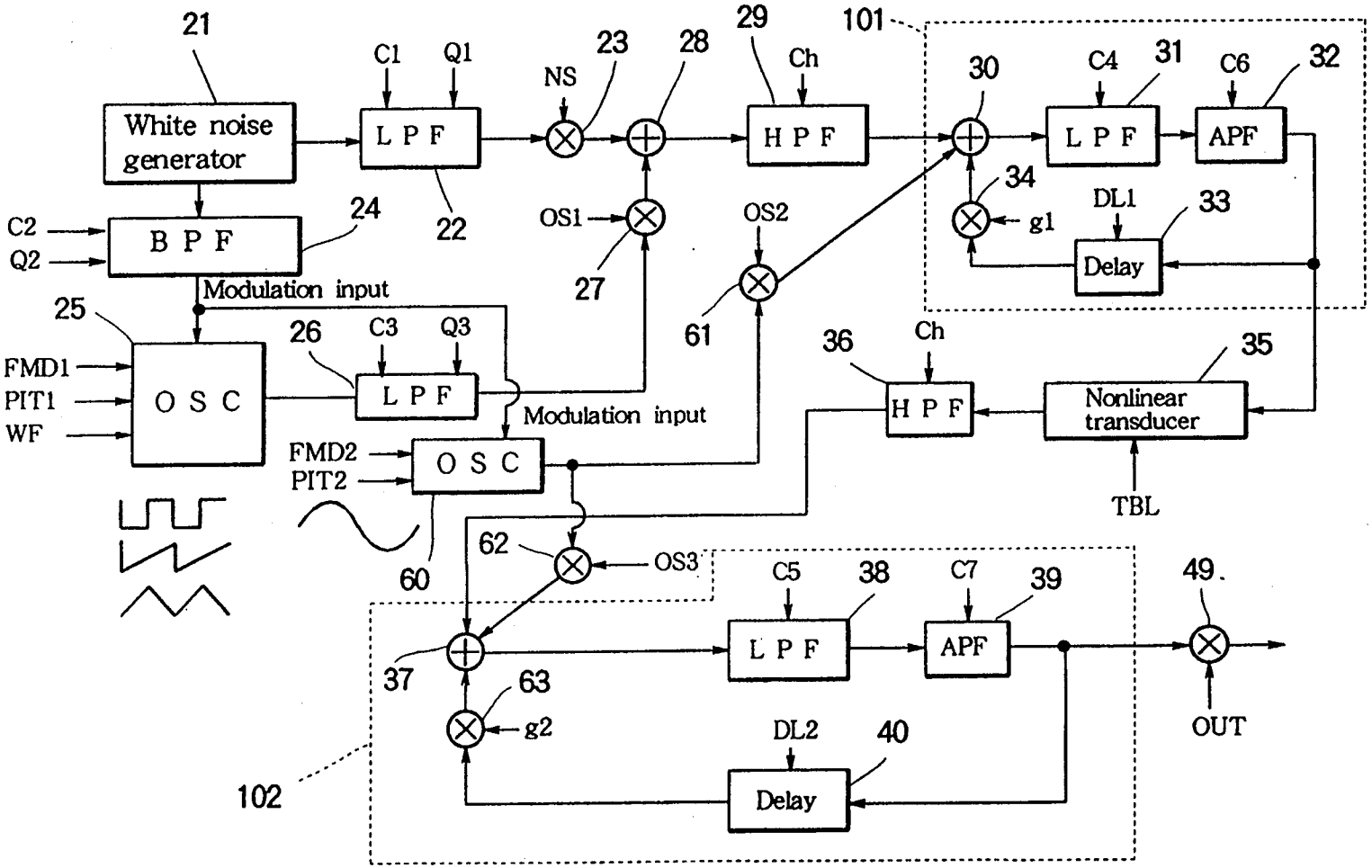
FIG. 7 is a circuit diagram showing a third embodiment of the musical tone synthesizing apparatus.

FIG. 7 is a block diagram showing a third embodiment of the inventive musical tone synthesizing unit. In the figure, the same component is labeled by the same reference numeral as in the FIG. 3 embodiment. In this embodiment, there are newly provided an additional oscillator 60 and multipliers 61, 62. An output of the oscillator 60 is fed through the multiplier 61 to the adder 30 of the first loop circuit 101, and is also fed through the other multiplier 62 to the adder 37 of the second loop circuit 102. Further, the equalizer is eliminated, and the output terminal of the second loop circuit 102 is connected directly to the multiplier 49. The oscillator 60 receives those of a modulation input from the output terminal of the BPF 24, a coefficient FMD2 effective to control a depth of the modulation, and another coefficient PIT2 effective to control an oscillating frequency. The oscillator 60 generates a sine wave signal. Further, the multipliers 61, 62 receive control coefficients OS2, OS3, respectively, effective to control amplitude levels of outputs from the oscillator 60. The remaining parts of this embodiment are identical to those of the FIG. 3 embodiment.

In operation of this embodiment, the frequency of the oscillator 60 is tuned identically to the fundamental resonance frequency f1 of the comb filters in the form of the loop circuits 101 and 102. The output of the oscillator 60 is injected into the loop circuits 101, 102 to add a specific low frequency component which is indispensable to the synthesized tone. Such an operation can prevent deterioration of the tone color, which would be caused by inserting the HPFs 29 and 36. In the oscillator 60, the sine wave signal is modulated by the white noise signal in order to avoid excessive intensification of the fundamental frequency f1 and to impart adequate fluctuation, thereby achieving realistic synthesis of musical tone. The control coefficient FMD2 is utilized to determine degree of the fluctuation, and therefore has a rather small value. In modification of this embodiment, the output of the oscillator 60 may be injected at a desired node inside or rearward of the loop circuits 101, 102. Further, the oscillator 60 may generate other wave signals such as a triangular wave signal having rather small higher harmonics, instead of the generally most desirable sine wave signal. Moreover, in case of using an oscillating waveform containing considerable higher harmonics or in case that the control coefficient FMD2 is set large, the oscillating frequency of the oscillator 60 may be set lower than the fundamental frequency f1 by one octave.

As described above, according to the invention, the HPF is connected precedingly to the loop circuit of the musical tone synthesizing apparatus so as to attenuate lower frequency components contained in a primitive input signal outputted from the input signal generator, thereby avoiding occurrence of overflow in operation of the loop circuit. Further, there is provided means for compensating for the attenuated lower frequency components, thereby preventing deterioration of the synthesized musical tones.

What is claimed is:

1. A musical tone synthesizing apparatus comprising:

a plurality of loop means connected in series for circulating and delaying an input signal having a plurality of frequency components in accordance with a selected delay time to produce an output signal representative of a musical tone, each of the loop means including:

delay means for delaying the input signal in accordance with the selected delay time;

feedback means for feeding back the delayed input signal to the delay means;

designating means for designating a pitch of a musical tone to be synthesized;

control means for controlling the delay means according to the designated pitch so as to select the delay time of the loop means to thereby determine the pitch of the musical tone;

generating means for generating said input signal; and attenuating means connected external to one of the loop means for selectively attenuating predetermined lower frequency components of the input signal having periods longer than the set selected delay time of the loop means.

2. A musical tone synthesizing apparatus according to claim 1, wherein the generating means includes noise means for generating a white noise.

3. A musical tone synthesizing apparatus according to claim 2, wherein the generating means includes oscillating means for generating a wave signal composed of harmonic components and a fundamental component which has a period longer than the delay time of the loop means.

4. A musical tone synthesizing apparatus according to claim 3, wherein the generating means includes modulating means for modulating the wave signal in accordance with the white noise.

5. A musical tone synthesizing apparatus according to claim 3, wherein the oscillating means includes means for setting a period of the wave signal to vary a timbre of the musical tone according to the pitch thereof.

6. A musical tone synthesizing apparatus comprising:

loop means for circulating and delaying an input signal having a plurality of frequency components in accordance with a selected delay time to produce an output signal representative of a musical tone, the looping means including:

delay means for delaying the input signal by the selected delay time and feedback means for feeding back the delayed input signal to the delay means;

designating means for designating a pitch of a musical tone to be synthesized;

control means for controlling the delay means according to the designated pitch so as to select the delay time of the loop means to thereby determine the pitch of the musical tone;

generating means for generating said input signal;

a high-pass filter connected between the loop means and the generating means for selectively attenuating predetermined lower frequency components of the input signal having periods longer than the selected delay time of the loop means; and an output filter having a frequency characteristic determined in accordance with a frequency characteristic of the high-pass filter.

7. A musical tone synthesizing apparatus according to claim 6, wherein the output filter has a frequency characteristic determined so as to compensate for attenuation of the predetermined lower frequency components of the input signal by the high-pass filter.

8. A musical tone synthesizing apparatus according to claim 6, including nonlinear transducing means connected to the loop means for nonlinearly transducing an amplitude of the output signal.

9. A musical tone synthesizing apparatus according to claim 6, wherein the generating means includes noise generating means for generating a white noise.

10. A musical tone synthesizing apparatus comprising:

a plurality of loop means connected in series to each other for circulating and delaying an input signal having a plurality of frequency components in accordance with a selected delay time to produce an output signal representative of a musical tone, each loop means including:

delay means for delaying the input signal by the selected delay time and feedback means for feeding back the delayed input signal to the delay means;

control means for controlling the delay means of each loop means according to a characteristic of a musical tone to be synthesized so as to set select the delay time of the loop means to thereby determine a pitch of the musical tone;

generating means for generating said input signal; and a high-pass filter connected external to at least one of the loop means for selectively attenuating predetermined lower frequency components of the input signal having periods longer than the selected delay time of the at least one loop means.

11. A musical tone synthesizing apparatus comprising:

a plurality of looping means connected in series to each other for circulating and delaying an input signal having a plurality of frequency components in accordance with a set delay time to produce an output signal representative of a musical tone, each looping means including:

delay means for delaying the input signal by the set delay time and feedback means for feeding back the delayed input signal to the delay means;

control means for controlling the delay means of each looping means according to a characteristic of a musical tone to be synthesized so as to set the delay time of the looping means to thereby determine a pitch of the musical tone;

generating means for generating said input signal;

a high-pass filter connected prior to at least one of the looping means for selectively attenuating relatively lower frequency components of the input signal having periods longer than the set delay time of the looping means; and an output filter connected succeedingly to at least one of the looping means and having a frequency characteristic related to a frequency characteristic of the high-pass filter.

12. A musical tone synthesizing apparatus comprising:

looping means for receiving and circulating an input signal to produce an output signal representative of a musical tone, the looping means including:

delay means for delaying the input signal by a selectable delay time and feedback means for feeding back the delayed input signal to the delay means;

designating means for designating a pitch of a musical tone to be synthesized;

control means for controlling the delay means according to the designated pitch so as to select the delay time of the looping means to thereby determine the pitch of the musical tone;

generating means for generating said input signal containing various frequency components;

attenuating means connected prior to the looping means for selectively attenuating relatively lower frequency components of the input signal having periods longer than the set delay time of the looping means; and compensating means connected to the looping means for compensating for attenuation of the lower frequency components of the input signal by the attenuating means.

13. A musical tone synthesizing apparatus according to claim 12, wherein the compensating means comprises an oscillator for feeding a wave signal to the looping means effective to compensate for the attenuation of the lower frequency components of the input signal.

14. A musical tone synthesizing apparatus according to claim 12, wherein the compensating means comprises an equalizer connected succeedingly to the looping means.

15. A musical tone synthesizing apparatus according to claim 12, wherein the attenuating means comprises an encoder which functions as a high-pass filter, and the compensating means comprises a decoder which functions as an output filter and has a frequency characteristic complementary to that of the encoder.

16. A musical tone synthesizing apparatus according to claim 12, wherein the attenuating means comprises a high-pass filter having a variable cutoff frequency controllable according to the designated pitch.

17. A musical tone synthesizing apparatus comprising:

loop means for circulating and delaying by a selectable delay time an input signal having a plurality of frequency components to produce an output signal representative of a musical tone, the loop means including:

delay means for delaying the input signal in accordance with the delay time;

feedback means for feeding back the delayed input signal to the delay means;

designating means for designating a pitch of a musical tone to be synthesized;

control means for controlling the delay means according to the designated pitch so as to select the delay time of the loop means to thereby determine the pitch of the musical tone;

generating means for generating said input signal containing a plurality of frequency components;

nonlinear transducing means connected to an output of the generating means for nonlinearly transducing an amplitude of the input signal; and attenuating means connected between the nonlinear transducing means and the loop means for selectively attenuating predetermined lower frequency components of the input signal having periods longer than the selected delay time of the loop means.

18. A musical tone synthesizing apparatus according to claim 17 wherein the generating means includes noise generating means for generating a white noise.

19. A musical tone synthesizing apparatus according to claim 18, wherein the generating means includes oscillating means for generating a wave signal composed of harmonic components and a fundamental component which has a period longer than the delay time of the loop means.

20. A musical tone synthesizing apparatus according to claim 19, wherein the generating means includes modulating means for modulating the wave signal in accordance with the white noise.

21. A musical tone synthesizing apparatus according to claim 19, wherein the oscillating means includes means for setting a period of the wave signal to vary a timbre of the musical tone according to the pitch thereof.

* * * * *